United States Patent [19]

Muramatsu et al.

[11] Patent Number: 4,662,783

[45] Date of Patent: May 5, 1987

[54] FLEXIBLE MEMBRANEOUS WEIR

[75] Inventors: Tateo Muramatsu; Yasushi Enami, both of Yokohama; Hideaki Saito, Chigasaki; Kuninori Aramaki, Yokohama, all of Japan

[73] Assignee: Bridgestone Corporation, Tokyo, Japan

[21] Appl. No.: 700,572

[22] Filed: Feb. 11, 1985

[30] Foreign Application Priority Data

Mar. 26, 1984 [JP] Japan ..... 59-56323
May 23, 1984 [JP] Japan ..... 59-102470
Jul. 10, 1984 [JP] Japan ..... 59-141297

[51] Int. Cl.[4] ..... E02B 7/00
[52] U.S. Cl. ..... 405/115; 405/87
[58] Field of Search ..... 405/87, 91, 107, 115

[56] References Cited

U.S. PATENT DOCUMENTS 4,167,358 9/1979 Besha ..... 405/87

FOREIGN PATENT DOCUMENTS 37213 3/1983 Japan ..... 405/115

*Primary Examiner*—David H. Corbin
*Attorney, Agent, or Firm*—Armstrong, Nikaido, Marmelstein & Kubovcik

[57] ABSTRACT

A flexible membraneous weir is disclosed. When air once filled in an air type flexible membrane weir is discharged in order to cause it to collapse, its membraneous wall is deformed in a V-shape at one portion in the river width direction, and a stream concentrates into this portion. However, the portion where the V-deformation will be formed is not certain. Therefore, it is required to reinforce the whole area of the river-bed and the river wall at the down stream side. In view of the foregoing, means is provided for starting V-deformation onto a bag-shaped member as a main body of the weir in a predetermined portion at a time when the bag-shaped member is collapse from its erected state. With this arrangement, the stream can be concentrated on the predetermined portion only. Therefore reinforcement is required only for a river-bed portion corresponding to this portion.

7 Claims, 46 Drawing Figures

FLEXIBLE MEMBRANEOUS WEIR

BACKGROUND OF THE INVENTION

This invention relates to a structure of a flexible membraneous weir, and more particularly to a flexible membraneous weir for which a V-deformation starts in a predetermined portion at one stage of its collapsing process.

Generally, an air type flexible membraneous weir disposed across a river is erected by charging air therein and collapsed by discharging air therefrom. Contrary to a water type flexible membraneous weir which is erected by charging water therein and collapsed by discharging water therefrom, with regard to the air type membraneous weir, if air once filled therein is discharged in order to collapse it, its membrane wall starts deforming in the shape of a letter "V" at one portion or two in the river width direction at a time when the internal pressure is decreased to such an extent as to make its weir height to be about 70% of the initial weir height (a V-notch phenomenon). The result is a concentration of the stream into said V-notch portion. Furthermore, the portion where the V-notch phenomenon will occur is not certain, since it depends on various factors such as a geographical form of a river, a state of a stream, differences of workmanship of a flexible membraneous weir and the like. Therefore, there is a possiblity that said V-notch phenomenon will occur in the vicinity of the surfaces of the river walls and that the flow concentrates on this portion. As a result, the river wall at the down stream side will be excavated and the banks will be damaged. In order to prevent the foregoing, the river walls at the down stream side are required to be reinforced. Likewise, in order to be ready for concentration of the flowing at any places, protection bed for preventing the excavation is required to be constructed along the whole area in the river width direction which often results in high costs of the construction fees. The present invention was accomplished in view of the above.

SUMMARY OF THE INVENTION

It is therefore a primary object of the present invention to provide a flexible membraneous weir wherein said V-formation starts at a predetermined portion.

Another object of the invention is a provision of a flexible membraneous weir wherein the configuration of the river-bed surface where the down stream side of a bag-shaped member as a main body of the flexible membraneous weir contacts at a time when it collapses is deliberately selected in advance, so that said V-deformation will be started at a predetermined portion of said bag-shaped member.

A further object of the present invention is a provision of a flexible membraneous weir wherein means for delaying the collapsing of other portion compared with one portion in its elongated direction is provided within said bag-shaped member so that the V-deformation will be started at a predetermined portion.

Still a further object of the invention is to provide a flexible membraneous weir wherein flexible tension means for connecting an upper stream side membrane wall to a down stream side membrane wall of said bag-shaped member is provided within said bag-shaped member so that said V-deformation will be started at a predetermined portion.

In order to achieve the above objects and others, there is essentially provided a flexible membraneous weir disposed across a river and which can be erected or collapsed by charging air thereto or by discharging air therefrom comprising means for starting deformation of a bag-shaped member as a main body of the weir into a letter "V" shape in a predetermined portion thereof at a time when said bag-shaped member is caused to be in a collapsed state from an erected state.

The above and other objects and features of the present invention will become more apparent by the following description when read in connection with the accompanying drawings.

BRIEF DESCRIPTION OF THE DRAWINGS

FIG. 34 through FIG. 36 illustrate a twelfth embodiment of the present invention wherein FIG. 34 and FIG. 36 are vertical sectional views and FIG. 35 is a plan view;

DETAILED DESCRIPTION OF THE EMBODIMENTS

Figure 1:
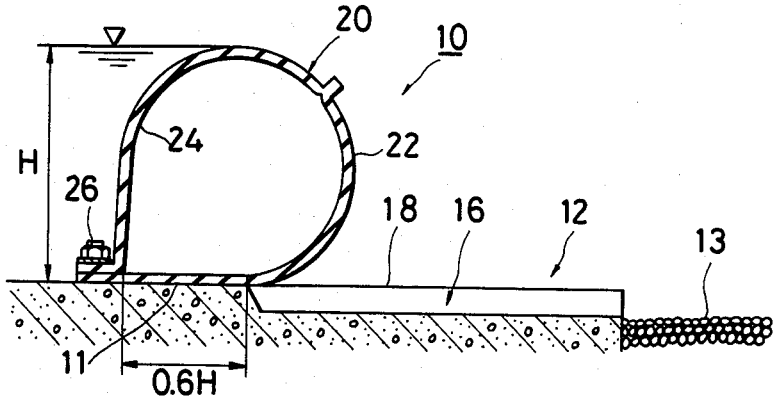
FIG. 1 is a vertical sectional elevation of a first embodiment of the present invention and a sectional view taken along line I—I of FIG. 2.
Figure 2:
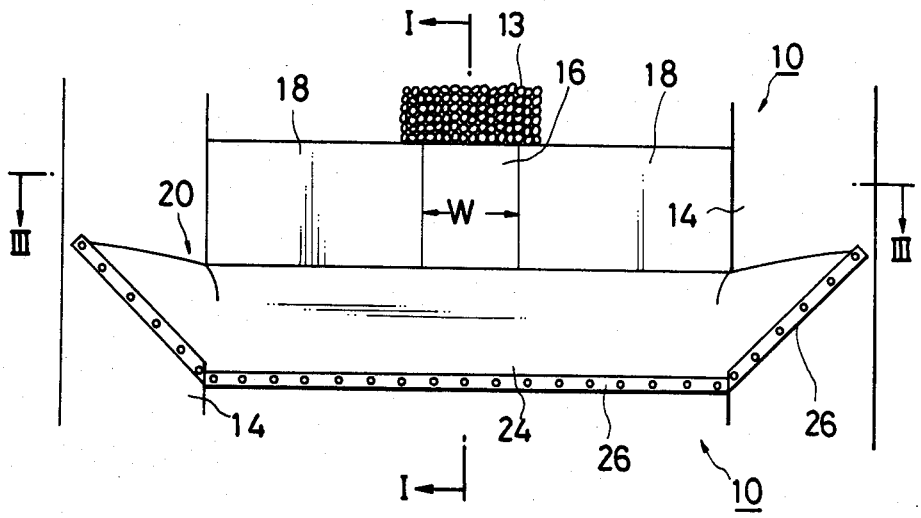
FIG. 2 is a plan view of the above.
Figure 3A:
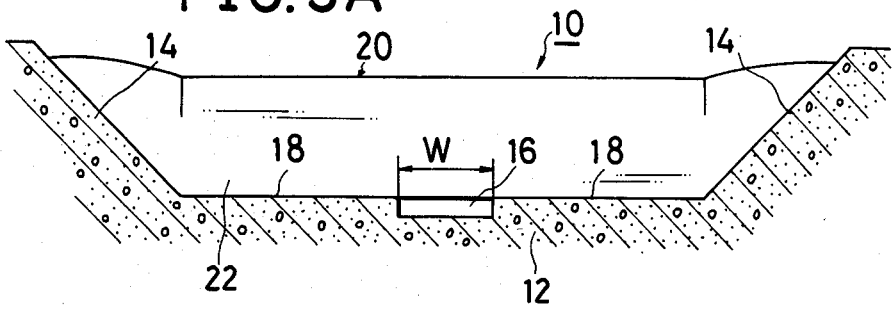
FIG. 3A is a sectional view taken on line III—III of FIG. 2.
Figure 3B:
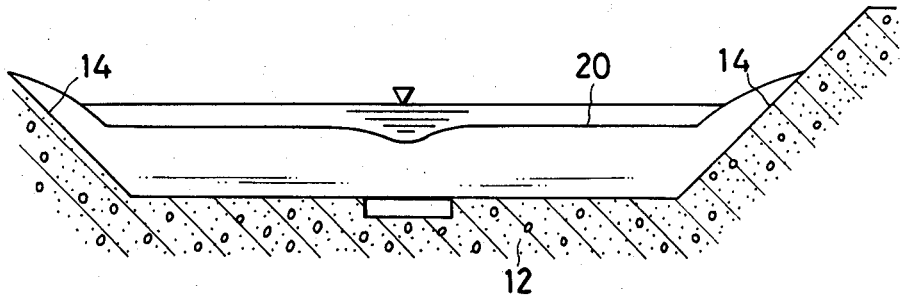
FIG. 3B is likewise a sectional view as same as FIG. 3A but showing its collapsed state.
Figure 4:
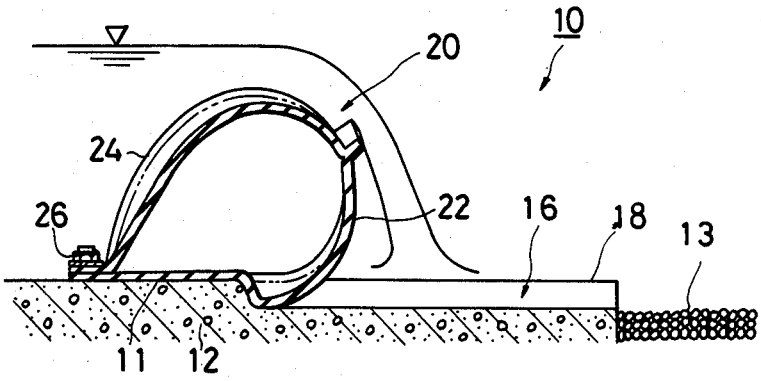
FIG. 4 and FIG. 5 are vertical sectional views showing the collapsed states thereof.
Figure 5:
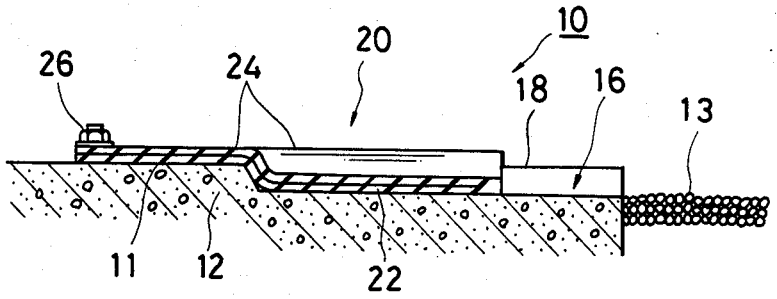

Various embodiments of the present invention will now be described with reference to the accompanying drawings in which like numerals denote like or corresponding parts throughout the several sheets.

FIG. 1 through FIG. 5 illustrate a first embodiment of the present invention. In these figures numeral 10 generally denotes the membraneous weir and 20 is bag-shaped member which constitutes a main body of said membraneous weir. As apparent from FIGS. 1 and 2, the bag-shaped member 20 is formed of a strip-shaped rubber membrane folded in two, said rubber membrane being fastened at its free ends to a river bed 12 and surfaces 14 of the both river sides with the use of a presser metal piece 26. In FIG. 1 through FIG. 3A, the bag-shaped member 20 is shown in a completely erected state where the water is at the maximum level or full (depth of water: H) at the upper stream side of the member 20.

When the internal pressure of the bag-shaped member is identical with the water head H at the upper stream side where the water is full, the length of a contact surface 11 of the river bed which contacts with the down stream side surface of the bag-shaped member is known to be approximately 0.6H. Consequently, in this membraneous weir 10, the river bed 12 is formed as a flat contact surface 11 at an even level within the area of 0.6 H length measured along the stream direction starting from the portion where the bag-shaped member 20 is pressed by the presser metal piece 26. A river bed surface at the down stream side with respect to the contact surface 11 is formed with a recess 16 having a width of W and located in the central portion of the river in its width direction, and other river bed surfaces 18 are formed flat at the same level as said contact surface 11 of 0.6 H length.

When discharge of the air within the bag-shaped member 20 in its completely erected state, as shown in FIG. 1, is started, the bag-shaped member 20 is gradually collapsed and the contact area of the down stream side membrane wall 22 with the river bed surface is increased. The membrane wall 22 which loses its support in the position of the recess 16 starts entering into the recess 16. When the weir height of the bag-shaped member 20 becomes approximately 0.7 H (critical time when a V-notch occurs), since the portion of the upper stream side membrane wall 24 confronting the membrane wall 22 which has entered into the recess 16 is lower than the other portion, this portion begins to deform in the shape of a letter "V" (V-notch) due to the water pressure. As a result, the flow of the river begins to concentrate on this portion (refer to FIGS. 3B and 4).

In the completely collapsed state, the central portion of the bag-shaped member 20 with respect to the river width direction is disposed along the inside of the recess 16.

In this way, according to the first embodiment, since the bag-shaped member 20 starts its V-deformation at the central portion thereof corresponding to the recess 16 position formed in the river bed 12 at one stage of its collapsing process, the river walls or the vicinity thereof at the down stream side will not be excavated and the damage to the bank can be effectively prevented.

The recess 16 may also be formed in any suitable position in the river width direction. Since it is enough to provide a protection bed 13 only in a position corresponding to the position where the recess 16 is formed, the construction costs are low compared with the case where the protection bed is provided along the whole length of the river width.

The length of the recess 16 in the stream direction may be determined in view of the dimension of the bag-shaped member 20. It may be shorter than that shown in the drawings.

Figure 6:
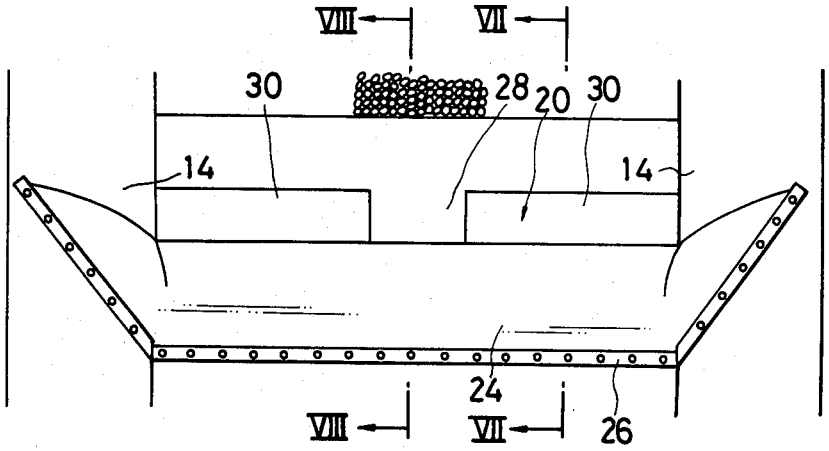
FIG. 6 is a plan view showing the second embodiment of the present invention.
Figure 7:
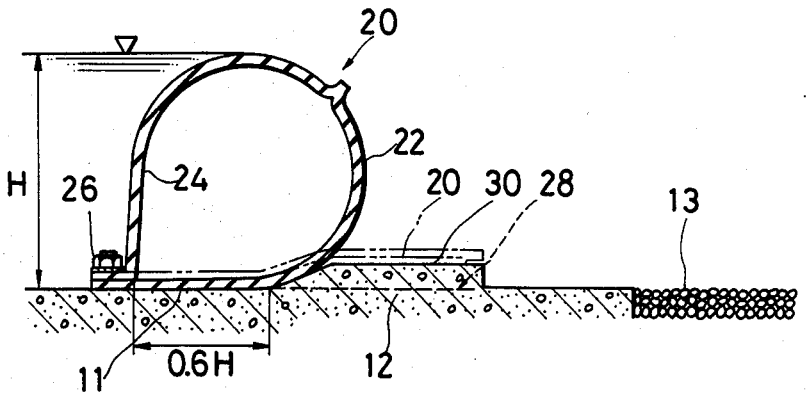
FIG. 7 is a sectional view taken on line VII—VII of FIG. 6.
Figure 8:
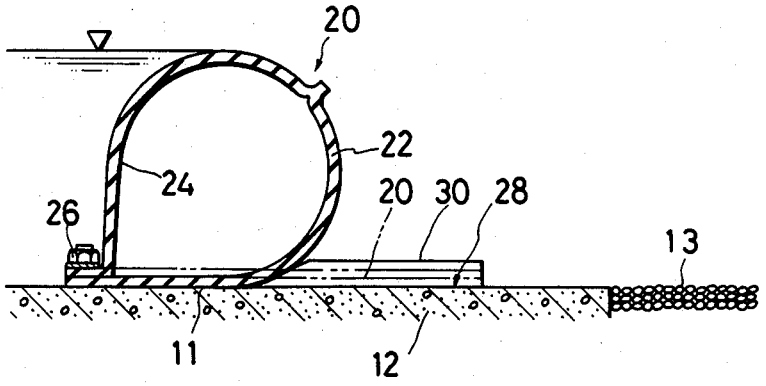
FIG. 8 is a sectional view taken on line VIII—VIII of FIG. 6.

FIG. 6 through FIG. 8 illustrate a second embodiment of the present invention. In these figures, the bag-shaped member 20 is shown in its completely erected attitude. The contact surface 11 which the down stream side membrane wall 22 contacts within the range of the length 0.6 H from the presser metal piece 26 is formed flat at an even level. The river bed surface at the down stream side with respect to said contact surface 11 is formed flat at the even level with respect to said contact surface 11 in the central portion 28 in the river width direction. Upheavals 30 are formed on the both sides of the central portion 28. Consequently, the portion 28 constitutes a recess relatively.

With the above construction of the membraneous weir, when the bag-shaped member 20 starts collapsing from its erected attitude, the down stream side membrane wall 22 begins to contact with the outer surface of the upheavals 30. At the critical time when a V-notch occurs, the portion of the upper stream side membraneous wall 24 corresponding to said portion 28 starts the V-deformation. In FIG. 8, the double dotted line shows the bagshaped member 20 is its completely collapsed state.

Figure 9:
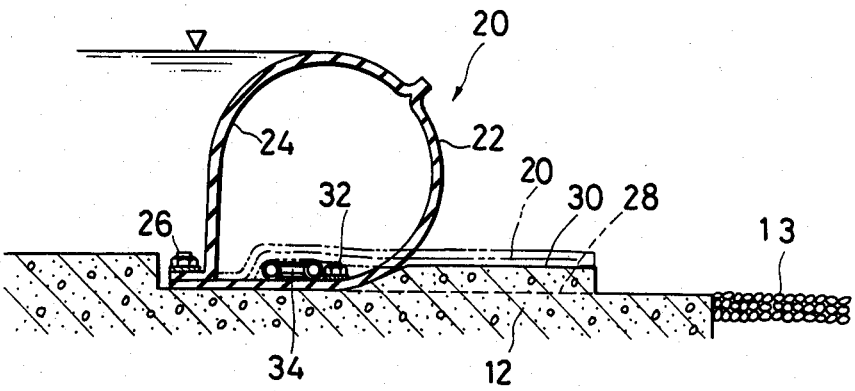
FIG. 9 is a vertical sectional view showing a modification of the above second embodiment.

In a modified embodiment as shown in FIG. 9, the bag-shaped member 20 is fixed by the presser metal piece 26, and at the same time, its down stream side membraneous wall 22 is also fixed by a presser metal piece 32 along the river width direction. In the figure, 34 denotes a ventilating member adapted to maintain the ventilation within the bag-shaped member 20 in the river width direction at the time when the V notch is formed.

Figure 10:
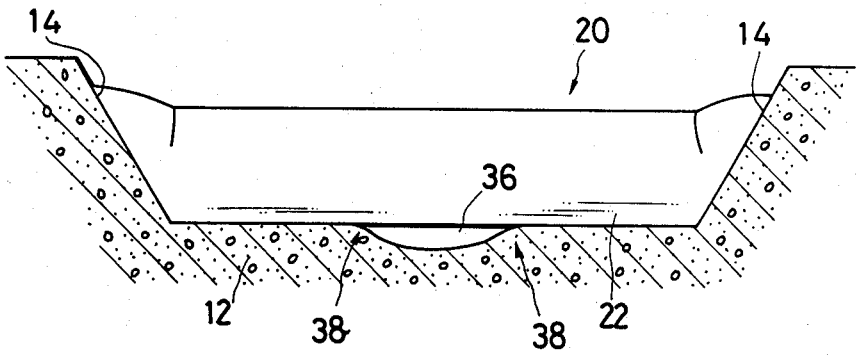
FIG. 10 is a cross sectional view similar to the one as shown in FIG. 3 but showing a third embodiment of the present invention.

A third embodiment of the present invention as shown in FIG. 10, is generally identical with the above mentioned first embodiment, but the configuration of a recess 36 is slightly different from that of said recess 16, and step portions 38 are formed as a smooth curved-surface. Because of the foregoing, there is no worry that the bag-shaped member 20 is scored by the sharp angles of the step portions at the time when the member 20 contacts with or separated from the recess.

Figure 11:
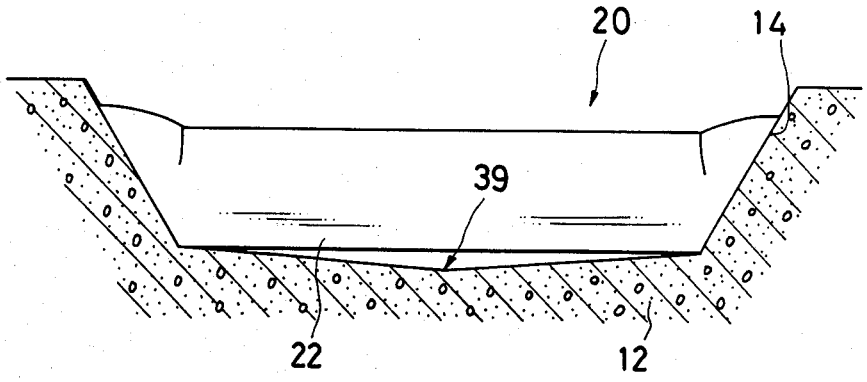
FIG. 11 is a cross sectional view showing a fourth embodiment of the present invention.

In a fourth embodiment as shown in FIG. 11, the river bed surface at the down stream side of said contact surface 11 (FIG. 1) is formed as such a gentle inclinded-surface as to be the lowest at the central position 39 in the river width direction and to be gradually raised toward the both ends in the river width direction.

When the bag-shaped member 20 is collapsed, the V-deformation occurs at a portion corresponding to the lowest position of the inclined surface.

In a fifth embodiment as shown in FIG. 12 through FIG. 15, the central portion of the river bed 12 is formed as a recess 40 from the upper stream to the down stream of the membraneous weir, and the circumference of the central portion of the bag-shaped member 42, i.e., the circumference of the portion corresponding to the recess 40 is larger than the other portion.

Consequently, at the recess 40, its presser metal piece 45 is positioned in an upper stream side relative to a presser metal piece 44 at other portion. The presser metal piece 45 is displaced as above in order to uniform the weir height as a whole when the bag-shaped member 42 is completely erected.

Figure 12:
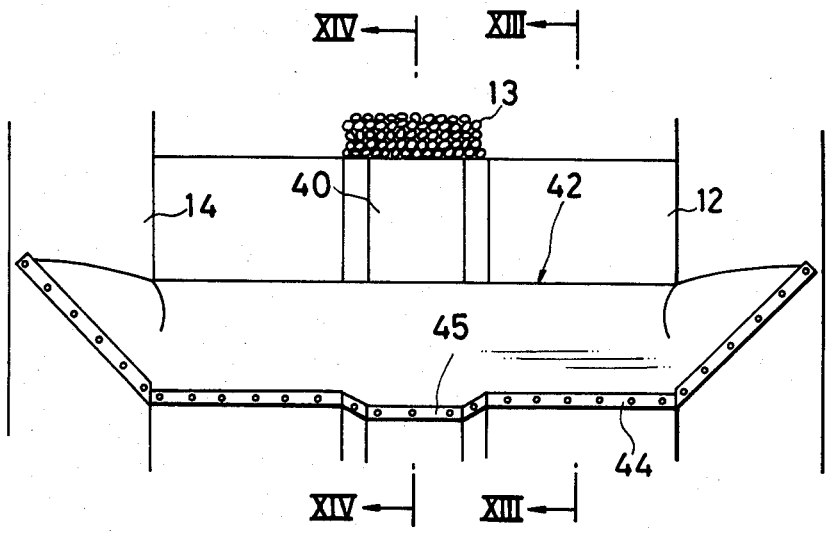
FIG. 12 is a plan view showing a fifth embodiment of the present embodiment.
Figure 13:
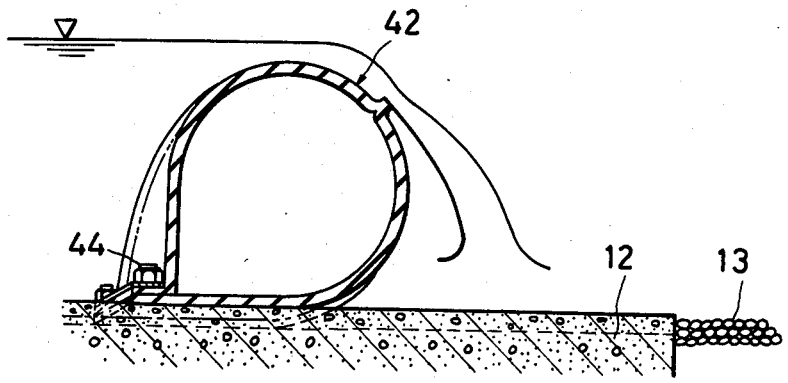
FIG. 13 is a sectional view taken on line XIII—XIII of FIG. 12.
Figure 14:
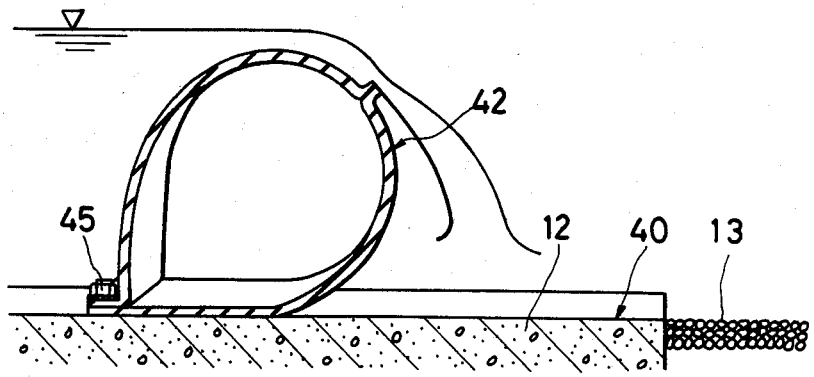
FIG. 14 is a sectional view taken on line XIV—XIV of FIG. 12.
Figure 15:
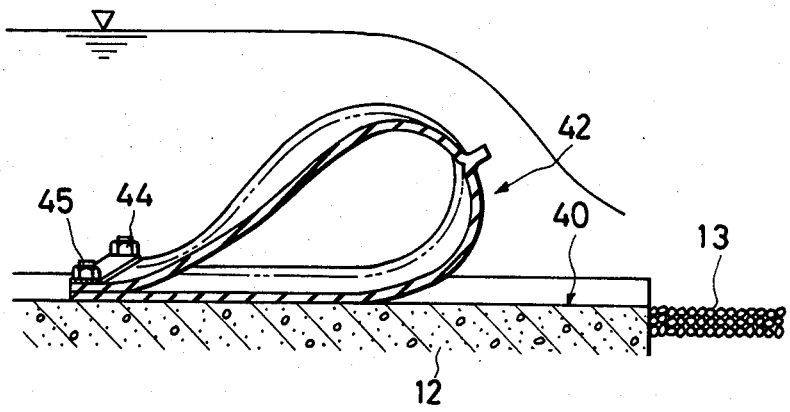
FIG. 15 is a vertical sectional view of the above but showing its collapsed state.

With the above structure of the weir, when the bag-shaped member 42 begins to collapse from its completely erected attitude as shown in FIG. 12 through FIG. 14, the V-deformation will start at a portion corresponding to the recess 40 (refer to FIG. 15) at the critical time when a V-notch occurs.

Figure 16:
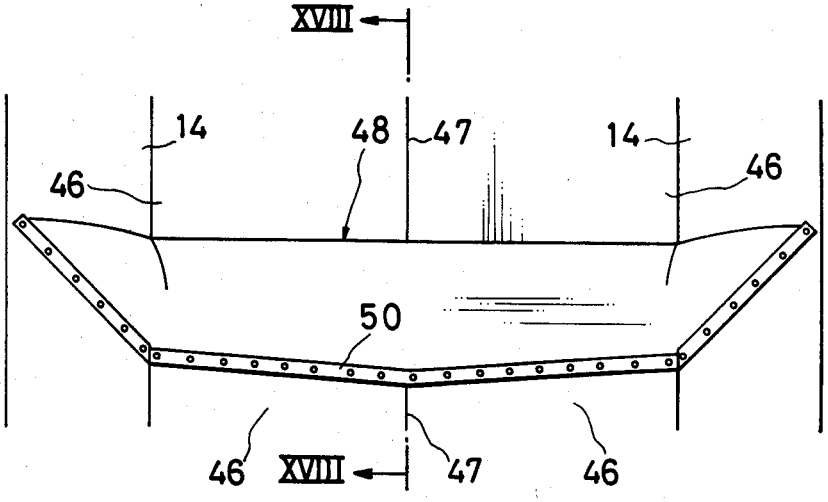
FIG. 16 is a plan view showing a sixth embodiment of the present invention.
Figure 17:
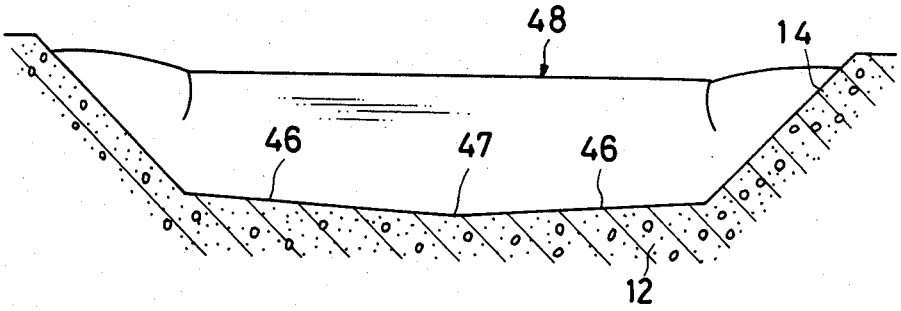
FIG. 17 is a cross sectional view of the above similar to FIG. 3.
Figure 18:
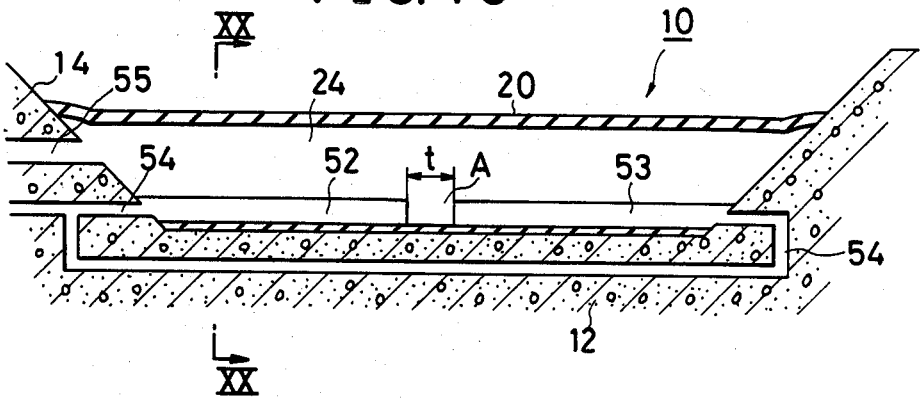
FIG. 18 is a sectional view of a seventh embodiment taken along the transversing direction of a river.
Figure 19:
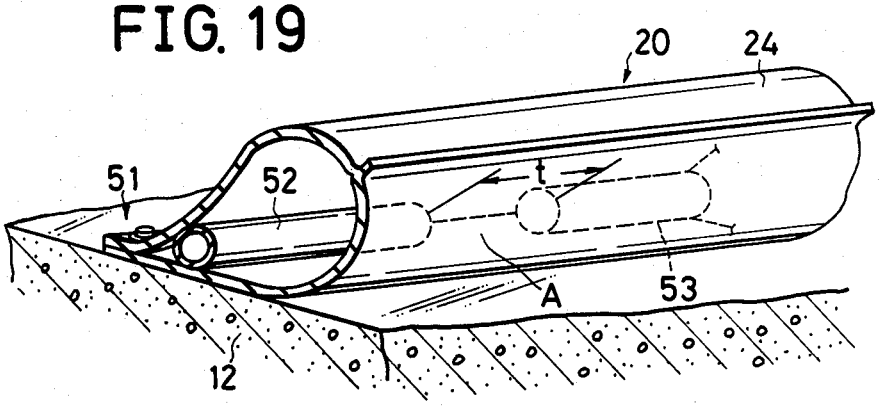
FIG. 19 is a perspective view of the above partly cut.
Figure 20:
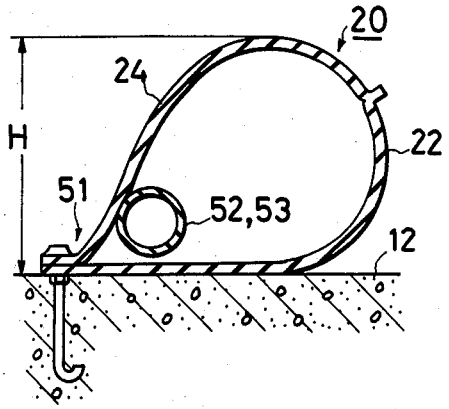
FIG. 20 is a vertical sectional view taken on line XX—XX of FIG. 18.
Figure 21:
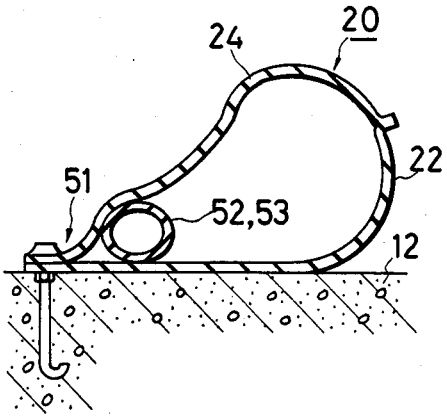
FIG. 21 is a vertical sectional view of the above but showing its collapsed state.

In a sixth embodiment as shown in FIG. 16 and FIG. 17, the river bed 12 is formed as a gentle inclined-surface 46 as a whole, and its central portion 47 is at the lowest level. The circumferencial length of the bag-shaped member 48 is the largest at a portion corresponding to the central portion 47 and gradually decreases toward the both ends, although the bag-shaped member 48 has no differences in the weir height in its river width direction. Therefore, a presser metal piece 50 is most displaced toward the upper stream side at a portion corresponding to the central portion 47 and fixed in an inclined fashion.

With the above structure of the membraneous weir, when the bag-shaped member 48 is caused to collapse from its completely erected state, its portion corresponding to the central portion 47 of the inclined surface 46 begins to deform in a V shape at the critical time when a V-notch occurs.

FIG. 18 through FIG. 23 illustrate a seventh embodiment according to the present invention. In this embodiment, a pair of cylinders 52 and 53 formed of rubber material and extending in the river width direction are integrally connected to the internal surface of the upper stream side membraneous wall 24 of the bag-shaped member 20 in a position close to a fixed portion 51. The external ends of the cylinders 52 and 53 are air-tightly fixed to the surfaces 14, respectively, and communicated with a charge-and-discharge pipe 54. The closed internal ends of the cylinders 52 and 53 are spaced apart from each other with a distance t defined therebetween. This separated portion A is in a generally central position in the river width direction. The bag-shaped member 20 and the cylinders 52 and 53 are independently charged and discharged through the charge-and-discharge pipes 55 and 54.

Figure 22:
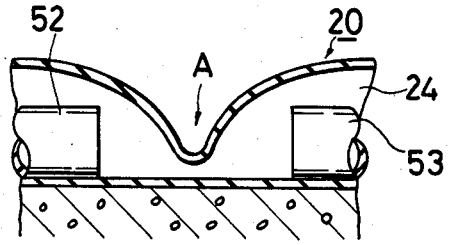
FIG. 22 is a cross sectional view showing its collapsed state as shown in FIG. 21.
Figure 23:
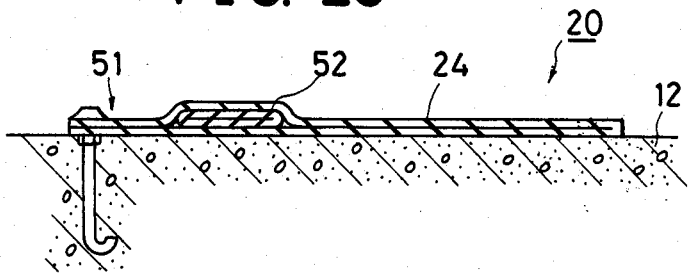
FIG. 23 is a vertical sectional view showing its completely collapsed state.
Figure 24:
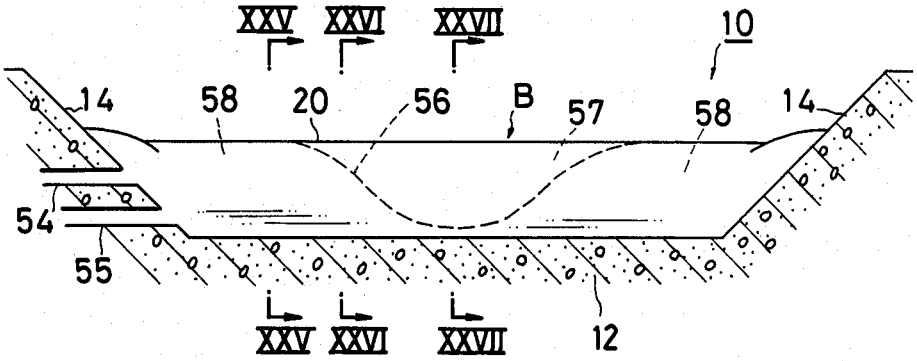
FIG. 24 is a front view, partly in section, of an eighth embodiment of the present invention when viewed in the flowing direction of a river.
Figure 25:
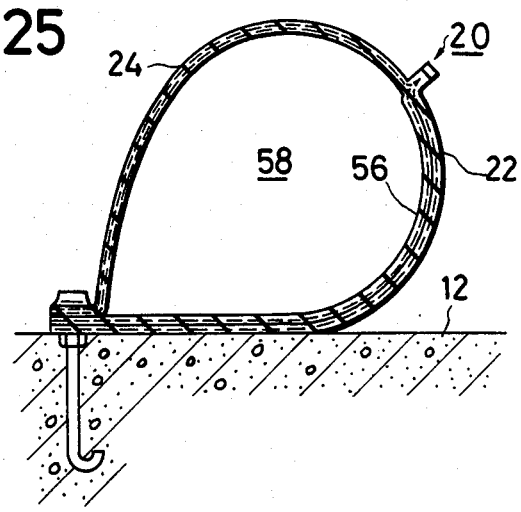
FIG. 25 through FIG. 27 are sectional views taken along lines XXV—XXV, XXVI—XXVI and XXVII—XXVII of FIG. 24, respectively.
Figure 26:
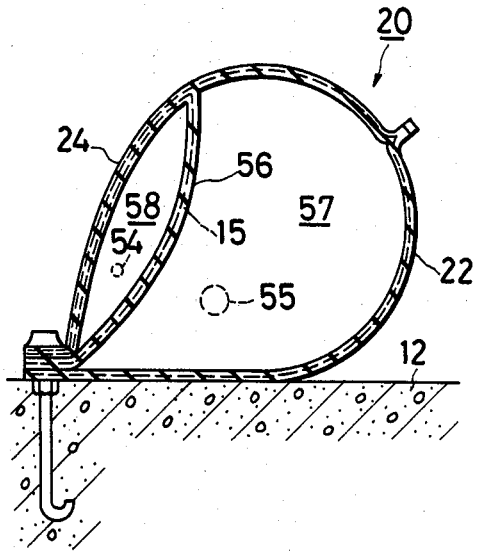
Figure 27:
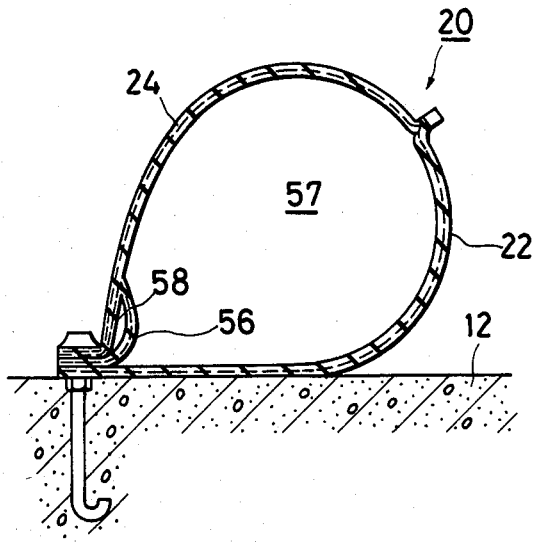
Figure 28:
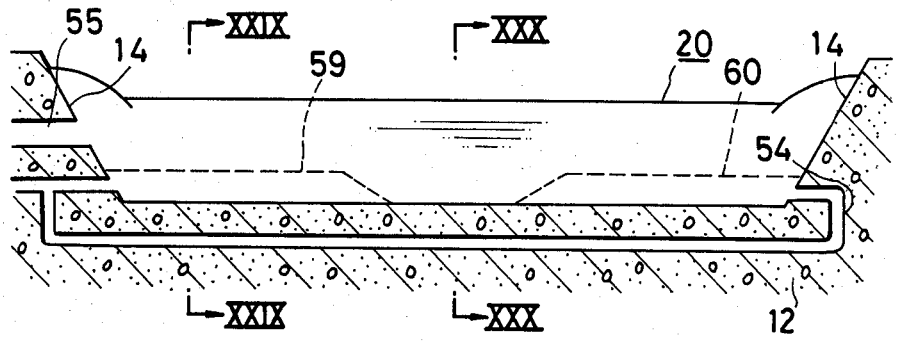
FIG. 28 is a front view, partly in section, of a ninth embodiment of the present invention when viewed in the flowing direction of a river.

In order to collapse this bag-shaped member 20, firstly, the bag-shaped member 20 is discharged through the discharge pipe 55. Then, the bag-shaped member 20 starts collapsing and after the cylinders 52 and 53 contact with the down stream side membrane wall 22, the portion of the upper stream side membrane wall 24 including the cylinders 52 and 53 cannot collapse any further. While, an A portion which does not include the cylinders 52 and 53 sinks in the V shape as shown in FIG. 22. After the discharge of the air within the bag-shaped member 20 is completed, or in the middle of the discharging of the bag-shaped member 20, the cylinders 52 and 53 are discharged through the charge-and-discharge pipes 54 thereby collapsing the bag-shaped member 20 completely (refer to FIG. 23).

A test was carried out in the following condition. River width: 3 m, Weir height H of membraneous weir 10: 10 cm, Outer diameters of cylinders 52,53: 2 cm, and Distance t of separated portion A defined between cylinders 52 and 53: 30 cm. The result was that the V notch was always occurred in the separated portion A when it collapses.

In an eighth embodiment of FIG. 24 through FIG. 27, the inside of the bag-shaped member 20 is partitioned into a first chamber 57 positioned at the down stream side and a second chamber 58 positioned at the upper stream side by a partition membrane 56. The second chamber is so designed as to be the smallest at the central position B of the river width direction and becomes gradually larger toward the surfaces 14 of the both river banks. The bag-shaped member 20 which changes its configuration in the river width direction is shown in sectional views in FIG. 25 through FIG. 27.

When said bag-shaped member 20 is collapsed, firstly, the first chamber 57 is discharged through the pipe 55. In the meantime, the second chamber 58 is not discharged. Therefore, the second chamber 58 conducts the same work as said cylinders 52 and 53 to cause a V notch to occur at the central position B portion.

Figure 29:
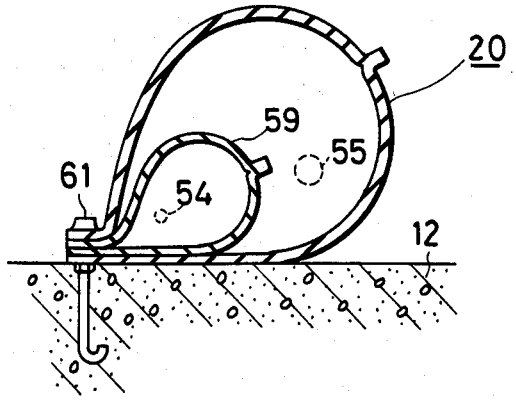
FIG. 29 and FIG. 30 are sectional views taken on lines XXIX—XXIX and XXX—XXX of FIG. 28, respectively.
Figure 30:
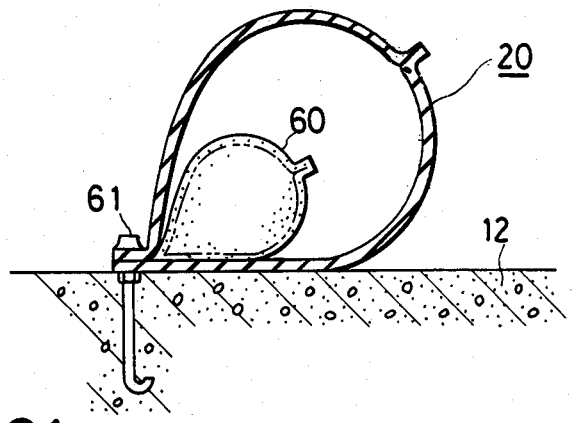

In a ninth embodiment shown in FIG. 29 and FIG. 30, instead of the cylinders 52 and 53 used in the above seventh embodiment, small bag members 59 and 60 which perform the same function as the cylinders 52 and 53 are employed. These small bag members 59 and 60 are formed, as in the case with the bag-shaped member 20, by folding a rubber strip piece in two and the free ends thereof are fastened tight together with the bag-shaped member 20 by an anchor bolt 61.

Figure 31:
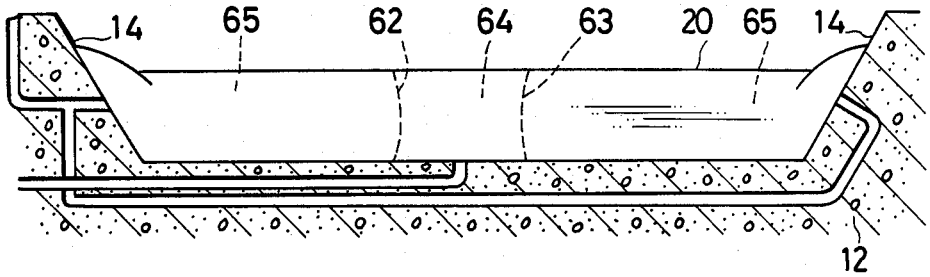
FIG. 31 is a front view, partly in section, of a tenth embodiment of the present invention when viewed in the flowing direction of a river.
Figure 32:
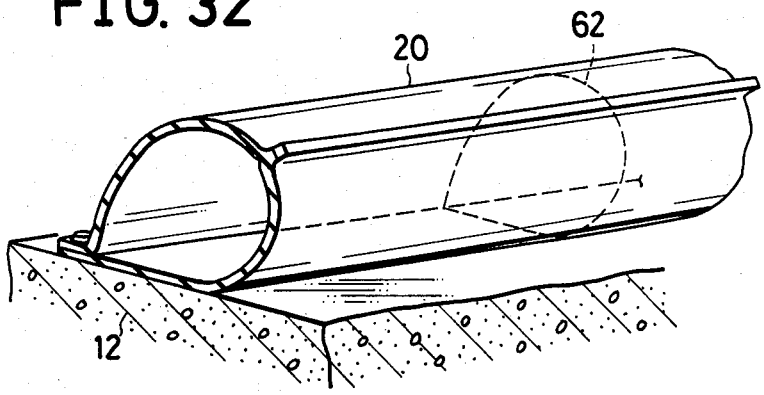
FIG. 32 is a perspective view showing the above partly cut.

In a tenth embodiment shown in FIG. 31 and FIG. 32, the inside of the bag shaped member 20 is divided into three chambers by a pair of partition walls 62 and 63. A chamber 64 positioned in the center is small compared with the other chambers 65,65 positioned adjacent thereto in the right and left positions. The chamber 64 is independently charged and discharged with respect to the chambers 65,65. In order to collapse it, the central chamber 64 is discharged first and then the side chambers 65,65 are discharged. In this way, it is apparent that the V-notch occurs at the portion of the central chamber 64.

Figure 33:
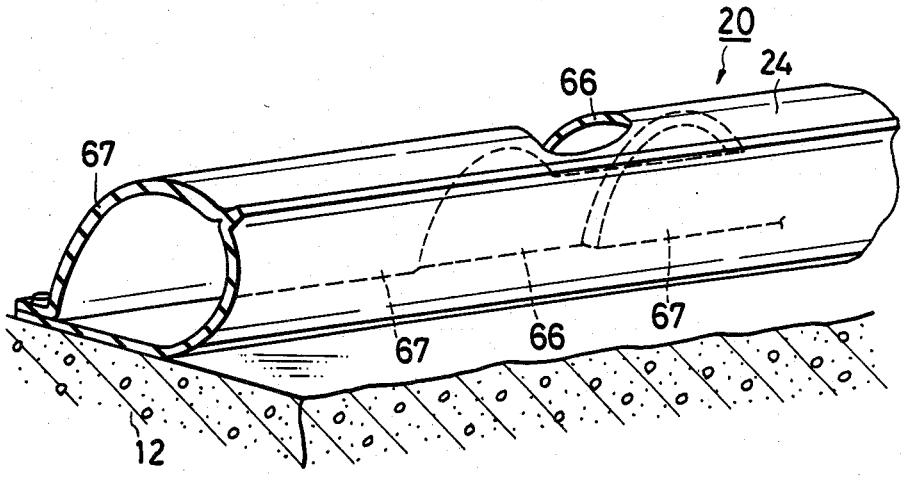
FIG. 33 is a perspective view, partly broken out, of an eleventh embodiment of the present invention.

In an eleventh embodiment shown in FIG.-33, the upper stream side membrane wall 24 of the bag-shaped member 20 is formed comparatively thin at the central portion 66 and comparatively thick at the side portions 67,67. Consequently, since the rigidity of the side portions 67,67 is larger than that of the central portion 66, the V notch necessarily occurs at the central portion 66 when the bag-shaped member 20 is collapsed.

Figure 34:
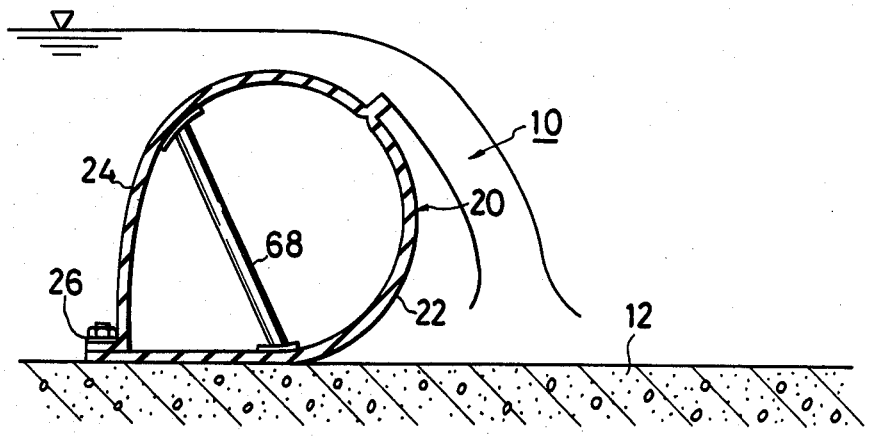
Figure 35:
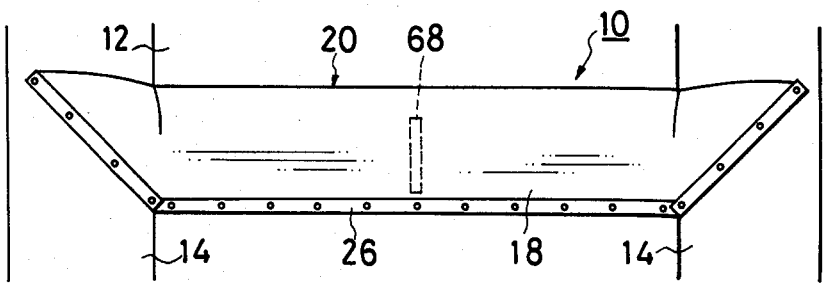
Figure 36:
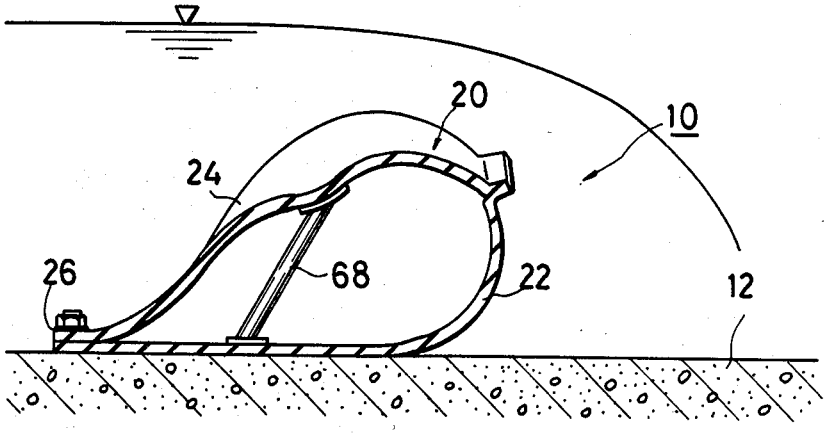

FIG. 34 through FIG. 36 illustrate a twelfth embodiment of the present invention. In this embodiment, the bag-shaped member 20 is provided at its inside in the central position in the river width direction with rubber tension means 68 for connecting the upper stream side membrane wall 24 with the down stream side membrane wall 22. The rubber tension means 68 may take any suitable shapes such as a string shape, strip shape, twisted shape or the like. The tension means 68, in its completely erected attitutde, is extended and fully tensioned. However, the force of the tension means 68 is not so strong as to partly lower the weir height of the bag-shaped member 20 in its completely erected attitude.

When the bag-shaped member 20 in its erected state as shown in FIGS. 34 and 35 is discharged, it begins to gradually collapse , and the portion of the upper stream side membrane wall 24 which is pulled by the tension means 68 is depressed. Subsequently, the bag-shaped member 20 begins to deform in the V shape from that portion as a starting point. As the degree of the collapsing of the bag-shaped member 20 proceeds, the tension means 68 is loosened and sandwitched by and between the both membrane walls 22 and 24 in the bent state.

Figure 37:
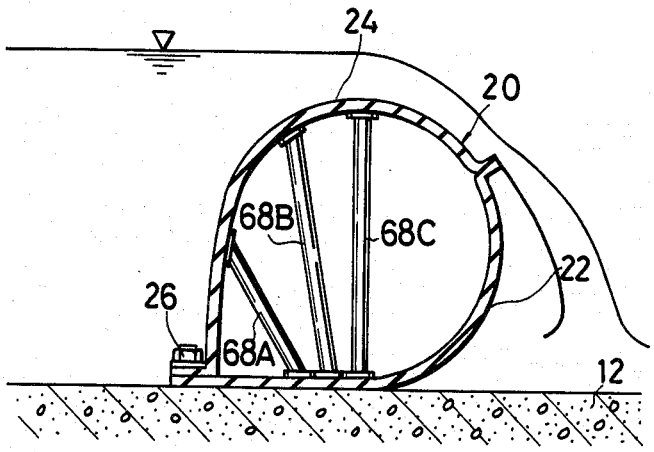
FIG. 37 is a vertical sectional view showing a modification of the above embodiment.

Several pieces, e.g., three pieces as shown in FIG. 37, of the tension means 68 may be provided. If several pieces of the tension means 68 are employed, the upper stream membrane wall 24 can be depressed more effectively.

Figure 38:
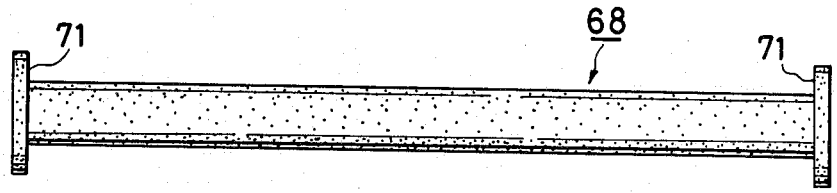
FIG. 38 is a view showing one example of a flexible tension material.
Figure 39:
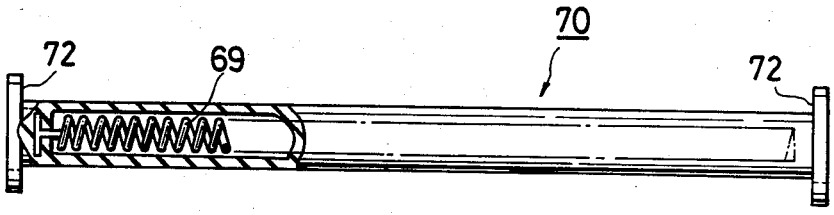
FIG. 39 is a view showing another example of the flexible tension material.

Also, as a tension means for deforming the bag-shaped member, besides the one made of rubber material as shown in FIG. 38, tension means 70 may be employed as shown in FIG. 39 wherein a tension spring 69 is contained within a rubber tube. In the drawings, 71 and 72 denote rubber connectors, and the same is firmly secured to the internal surfaces of the both membrane walls 22 and 24.

Figure 40:
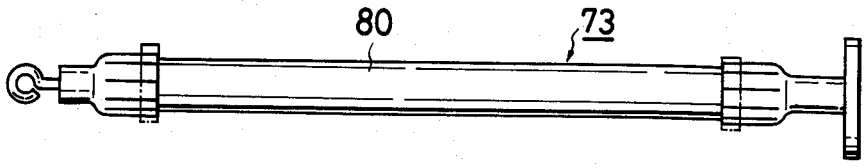
FIG. 40 through FIG. 42 are views showing rubber actuators as another example of the flexible tension means.
Figure 41:
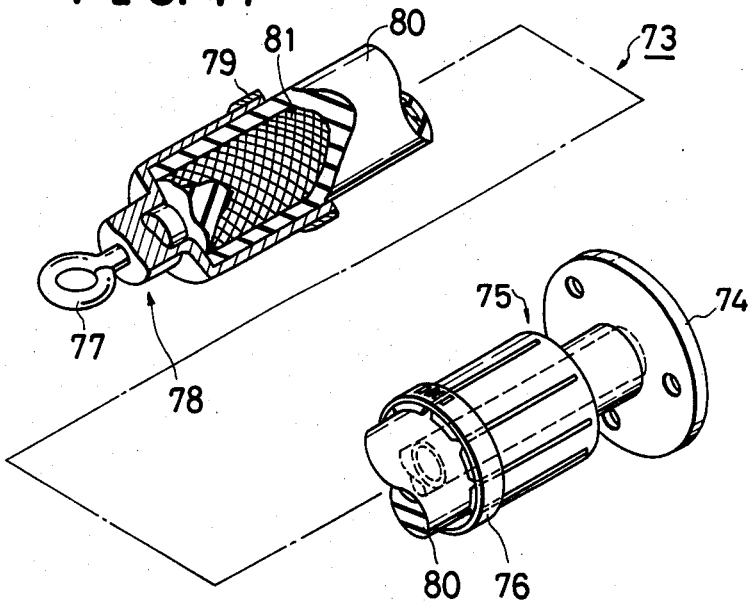
Figure 42:
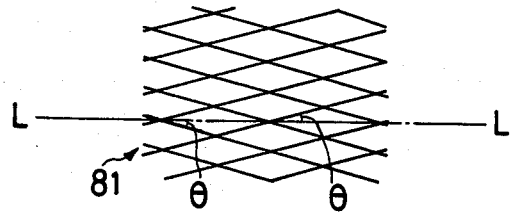

A tension means 73 shown in FIG. 40 through FIG. 42 is a rubber actuator, wherein a mouthpiece 75 including a flange 74 is mounted to one end of a tubular main body 80 formed of rubber material by a fastening band 76, and another mounthpiece 78 including a retaining ring 77 is mounted to the other end thereof by another fastening band 79. Although the mouthpiece 78 blocks said other end, the mouthpiece 45 does not block said one end. Within the tubular main body 80, a cylindrical cord 81 made of reinforced fiber material is embedded through its entire length. The orientation angles (the tilt angles with respect to the linear line L parallel to the axis of the tubular main body 80) of the cord 81 is arranged to be in a range of from about 15° to about 20°.

Consequently, if a compressed air is charged into the tubular main body 80 through the mouthpiece 75, the oriatation angles of the code 81 are changed and the diameter of the tubular main body 80 is increased until the $\phi$ becomes 54° 44′ and the length is reduced.

Figure 43:
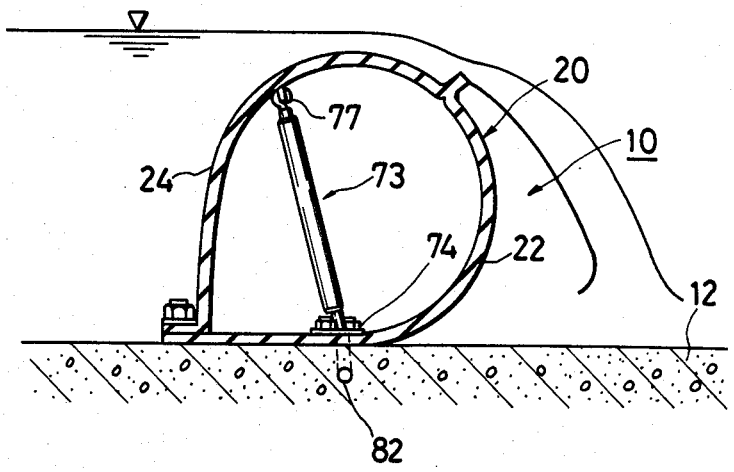
FIG. 43 through FIG. 45 are vertical sectional views of embodiments to which the above rubber actuators are applied.
Figure 44:
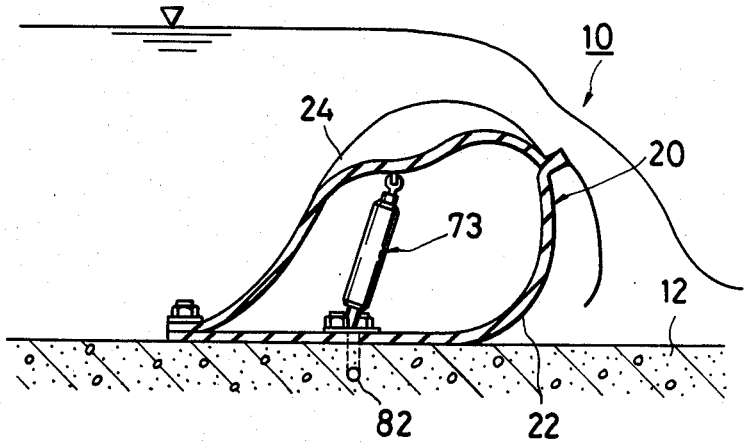
Figure 45:
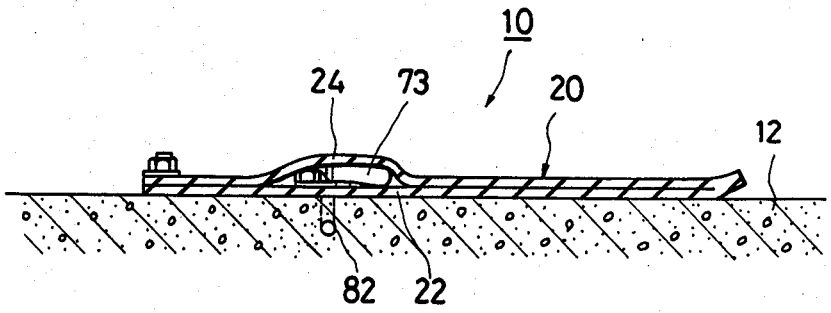

A membraneous weir 10 which employs a tension means 73 having such character is illustrated in FIGS. 43 through 45, wherein 82 denotes a charge-and-discharge pipe for charging into and discharging from the tension means 73. FIG. 43 illustrates a completely erected state of the weir 10, FIG. 44 illustrates the membraneous weir 10 at one stage of its collapsing process, and FIG. 45 illustrates a completely collapsing state thereof.

As described in detail in the foregoing, according to the present invention, the flexible membraneous weir begins to deform in a letter "V" shape at a predetermined portion when it collapses. Since the flowing of the river concentrates on this portion, a protection bed can be formed only in a position at the down stream side corresponding to said portion, thus enabling to reduce the construction costs. Furthermore, the banks can be protected from the concentration of the flowing by deliberately arranging to occur the V-deformation in a position far from the surfaces of the river walls.

While specific embodiments of the present invention have been shown and described in detail to illustrate the application of the principles of the invention, it will be understood that the invention may be embodied otherwise without departing from such principles.

What is claimed is:

1. A flexible membraneous weir disposed across a river and which can be erected or collapsed by charging air thereto or discharging air therefrom comprising:

a bag-shaped member;

means for mounting said bag shapeed member laterally of the river on the river bed surface;

means for starting deformation of said bag-shaped member as a main body of the weir into a letter "V" shape in a predetermined portion thereof at a time when said bag-shaped member is caused to be in a collapsed state from an erected state, said starting deformation means being a recess formed in the river-bed surface where a down stream side of said bag-shaped member contacts at a time when said member is caused to collapse, said recess being formed around a position corresponding to said predetermined portion and being lower than any other position of the river-bed surface.

2. A flexible membreneous weir according to claim 1, wherein said other position of the river-bed surface is of the same height as that of a contacting surface on the river-bed where said bag-shaped member contacts when in its erected state.

3. A flexible membreneous weir according to claim 1, wherein said other position of the river-bed surface is higher than said contacting surface, and said recess is of the same height as that of said contacting surface.

4. A flexible membraneous weir according to claim 1, wherein said recess is connected to said other position of the river-bed surface through a smooth curved surface.

5. A flexible membraneous weir according to claim 1, whrein said recess is extended till an upper stream side of said bag-shaped member, and a circumference at a poriton of said bag-shaped member corresponding to said recess is longer than that of any other portion of said bag-shaped member.

6. A flexible membraneous weir according to claim 1, wherein said river-bed surface being given a gentle inclined-surface in such a manner as to be lowest in a central position in the river width direction defining said recess and gradually raised toward the both ends in the river width direction, a top edge of said bag-shaped member when erected being substantially horizontal in the river width direction.

7. A flexible membraneous weir according to claim 6, wherein the circumference of said bag-shaped member is the longest around the central position in the river width direction and becomes gradually shorter toward the both ends thereof.

* * * * *